United States Patent [19]

Kuryla

[11] 3,995,648

[45] Dec. 7, 1976

[54] TOOTHBRUSH AND TOOTHPASTE SUPPLY CONTAINER

[76] Inventor: Michael A. Kuryla, 2777 SW. 22nd Ave., Miami, Fla. 33133

[22] Filed: Oct. 22, 1975

[21] Appl. No.: 624,988

Related U.S. Application Data

[63] Continuation-in-part of Ser. No. 505,327, Sept. 12, 1974, abandoned.

[52] U.S. Cl. ..... 132/84 B

[51] Int. Cl.[2] ..... A45D 44/18

[58] Field of Search ..... 132/84 A, 84 B, 79

[56] References Cited

UNITED STATES PATENTS

| | | | |
|---|---|---|---|
| 1,340,043 | 5/1920 | Grace | 132/84 R |
| 3,246,361 | 4/1966 | Blackmon | 132/84 R |

*Primary Examiner*—G.E. McNeill

[57] ABSTRACT

A toothbrush and toothpaste supply container, which are connected together threadably and in which there is a piston which is captivated for axial movement only, and is operable by an operator knob on the proximal end of the toothbrush handle and which is turned to advance the piston to cause toothpaste to travel through a passageway and be deposited in the brush array of the toothpaste.

1 Claim, 4 Drawing Figures

TOOTHBRUSH AND TOOTHPASTE SUPPLY CONTAINER

This is a continuation-in-part application of earlier filed U.S. patent application Ser. No. 505,327 now abandoned, filed Sept. 12, 1974 for A Toothbrush And Toothpaste Supply In Combination.

FIELD OF THE INVENTION

This invention relates to a toothbrush and, more particularly, to a toothbrush which contains a supply of toothpaste which is advanceable through a passageway from a stored position in the brush handle to the bristle or brush array.

BACKGROUND OF THE INVENTION

Oftentimes it is desired by travelers, among others, to have a toothbrush which can be stored in a convenient manner and which includes a supply of toothpaste. This invention provides a toothbrush and handle which are threadably connected together and in the handle of which there is stored an advanceable charge of toothpaste, which toothpaste can be applied to the brushes by rotating a piston which moves forwardly in response to rotation to discharge a desired amount of toothpaste and which is so constructed that when the toothpaste has been discharged from the container portion of the toothbrush assembly, the piston may be removed and the container charged with a new supply of toothpaste and the piston then reinserted to repeat the operation.

It is, accordingly, an object of this invention to provide an improved toothbrush which includes a toothpaste supply container of the type described hereinafter. The instant invention will now be described with reference to the accompanying drawings in which:

DESCRIPTION OF PREFERRED EMBODIMENT

Figure 1:
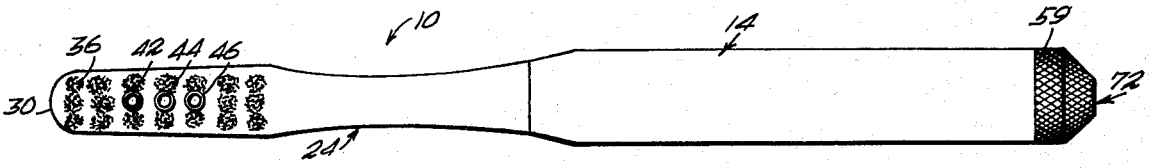
FIG. 1 is a plan view of a toothbrush constructed in accordance with this invention.
Figure 2:
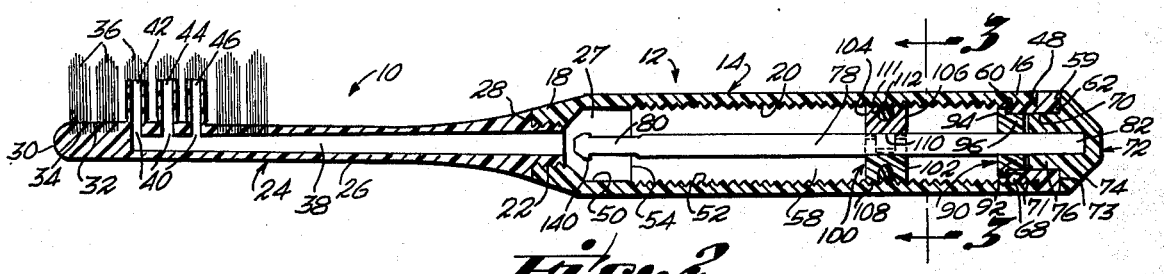
FIG. 2 is a side elevation view in cross section of the toothbrush shown in FIG. 1.
Figure 3:
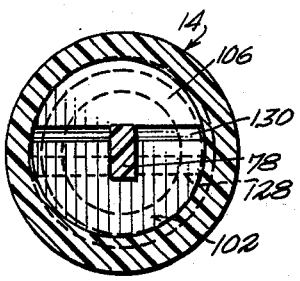
FIG. 3 is a view in cross section taken on the plane indicated by the line 3—3 of FIG. 2 and looking in the direction of the arrows.
Figure 4:
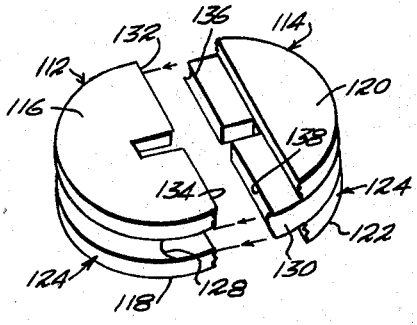
FIG. 4 is a perspective view illustrating the piston head which is collapsible.

Referring to the drawings, there is shown an improved toothbrush 10 which includes a handle form toothpaste supply container 12. The container portion includes a generally hollow barrel 14 of rigid material having a first end 16 and a second end 18. In the barrel, there is a longitudinally extending threaded axial bore 20 of uniform circular cross section defining a toothpaste chamber which extends from the first end toward and almost to the second end. The portion of the bore 20 adjacent the second end is not threaded, as seen in FIG. 2 and will later be referred to as a relaxation chamber. The second end of the barrel is provided with a threaded axial through bore 22 of reduced diameter relative to that of the bore 20 and this through bore 22 is in fluid communication with the relaxation chamber.

The brush portion 24 includes a body 26 with a proximal end 28 and a distal end 30. The distal end has a brush face 32 with spaced recesses 34 holding a plurality of bristles 36 arranged in an array. In the brush portion, a through passageway 38 extends from the proximal end through the body to a plurality of holes 40 which may have upstanding nipples 42, 44, and 46 with their respective distal ends being in the bristle array.

Suitable means are provided to connect the proximal end of the brush portion 24 to the handle 12 or toothpaste container with the interior of the brush in fluid communication with the relaxation chamber and main toothpaste holding chamber or bore 20 in the container. In the preferred embodiment illustrated, a male and female threaded connection is provided on the proximal end of the brush and the distal end of the barrel respectively. Also, in the preferred embodiment, the overall length between the ends of the barrel is about equal to the overall length of the brush portion, so that the two can be separated and the bore 22 capped for compact storage of the combination.

With further reference to the handle portion or toothpaste container of the preferred embodiment illustrated, the central barrel bore 20 has a first open proximal end 48 while adjacent the second or distal end 50 the relaxation chamber is located which as stated previously is in fluid communication with the through passageway of the brush. The barrel is internally threaded as at 52 the threads extending from the first end along the length thereof to a lateral plane 54 of the barrel which is adjacent to, but spaced from, the second end of the barrel. The second end of the bore is unthreaded and is hereinafter referred to as the piston relaxation chamber 26. The first end of the bore is hereinafter referred to as a charging chamber 58 to hold a charge of toothpaste.

A piston mechanism is provided for forcing selected amounts of toothpaste through the bore, i.e., the charging chamber, relaxation chamber, brush passageway and holes into the bristle array of the brush. That mechanism will now be described. A brushing type end gap 59 is provided in threaded engagement with the threaded first or proximal end of the barrel. The end cap has a distal first end zone 60 and a second proximal end zone 62. The second end zone is of a diameter greater than the diameter of the charging chamber and the first end zone defines an exteriorly threaded annular nose portion 68 which is sized for and is in threaded engagement with the threads of the charging chamber at the first end of the barrel. The end cap is provided with an axial through opening 70 to rotatably receive an operator means now to be described.

The piston mechanism operator means includes an operator knob 72 to rotatably operate the piston mechanism. The operator has an operating end zone 74 at all times exterior of the first end of the barrel and an annular end zone 76, which is of an axial length less than the axial length of the axial through opening 70 and is rotatably received in it. To the operator, a piston drive member or rod 78, which extends axially through the bore, is connected for moving a piston member in the bore to discharge the toothpaste.

The piston rod 78 has a first proximal end zone 82 of major axial length and a second or distal shorter or minor distal end zone 80. The distal end zone 80 is of a rectangular cross sectional area which is reduced or foreshortened relative to that of the major rod length for a purpose which will be apparent hereinafter. The terminal end of the second or proximal end zone 82 of the piston shaft is fixed or keyed to said operator knob for rotation with it, as by an adhesive or other suitable means.

A rotatable generally annular retainer or keeper 90 is provided to hold the piston and operator knob in assembly with the end cap. The retainer has a body 92 in a fixed axial position on the shaft; and it has (a) an annular portion 94 of a diameter greater than the diameter of the axial through opening 70 which provides a surface which bears against the second or distal end of the end cap which diameter is less than the diameter of the threaded barrel bore, and (b) an annular portion 96 rotatably received in the axial through opening of the end cap extending toward but not to the operator knob. Thus, in the assembled mechanism there is provided a bearing means for rotation of the shaft in the end cap axial passageway 70, the shoulders 71 and 73 rotatably holding the assembly in sandwiched relation about the opposite ends of the end cap which is in threaded engagement with the barrel threads.

The knob retainer and shaft are sized, mated and configured to coact with the end cap and barrel to comprise a labyrinth type seal means for the second end of the barrel to guard against leakage of the toothpaste.

An expandable piston 100 is mounted slidably on the shaft and it is in threaded engagement in the barrel bore so that it is adapted to be advanced or withdrawn by turning the operator knob. Generally, the piston is a disc-shaped assembly 102 composed of two mating portions, the assembly having axial end faces 104 and 106 with an exteriorly threaded body surface 108 between the end faces. The piston is provided with a rectangular axial through passageway 110 to slidingly accommodate the piston rod and a peripheral O-ring seat 111 in the threaded body surface between the faces to seat a resilient O-ring 112 under tension about the piston body. Preferably the O-ring seat is of a diameter such that in relation to the diameter of the O-ring, the O-ring serves as a wiper in addition to its main function, that of maintaining the mating portions in assembly as will be apparent hereinafter.

The proximal or second end zone 80 of the piston shaft 78 extends through the bore of the barrel to the lateral plane 54 of the barrel where the internal threads terminate. The distal or first end zone of the piston rod which extends into the relaxation chamber is of reduced cross sectional area and it extends from the second end zone within the relaxation chamber a distance at least equal to the axial distance between the piston faces. When the piston is advanced to the reduced cross sectional area zone of the rod, that is the first end zone, the O-ring causes the mating parts to shrink in diameter which will be apparent by reason of its construction as is explained in the following paragraph.

The piston assembly of the preferred embodiment icludes a first and a second generally semi-lunar U-shaped mating member 112 and 114. Each member has an opposite axial face 116, 118 and 120, 122, each of which comprises a portion of the end face of the piston. The end faces of each member are joined by a threaded exterior body surface 124 and 126. The base zone and outside surfaces of the leg zones of each of the U-shaped members comprises the threaded exterior body surface of the piston having the O-ring groove. Each of the legs of each member have terminal mating axial extending faces or surfaces configured to fit one another as will be described. The first piston assembly member is provided with a female recess 128 in the mating surface; and the second member is provided with a mating male tongue 130 in the mating surface, the tongue being sized for receipt in the recess. When in piston defining mated relation the curved exterior surfaces of the mating members are of a main radius of curvature about the base for threaded engagement in the base, i.e., the exterior surface of the members, matches that of the inside of the base. The terminal ends 132, 134 and 136 and 138 of the leg portions of the U-shaped members are of a slightly reduced radius of curvature. The main radius of the curvature is equal to the radius of curvature of the main bore of the barrel. The axial space between the legs of the respective members is companionately sized for sliding movement along the second or proximal end zone of the piston shaft which is sized to bear against the crotch between the legs to normally maintain the threads of the members in threaded engagement with the interior threads of the bore for threaded advancement of the piston with respect to the container when the operator rod is turned and the piston is on the second larger proximal end zone of the shaft. When it is advanced to the depth of the relaxation chamber the piston contracts.. The female groove is of a greater radial depth than the tongue so that, when the piston has been advanced so that it is on the first end zone of the rod, which is of reduced cross sectional area, the tension on the O-ring collapses the piston to a shrunken diameter so that thereafter it can then be pulled together with the operator from the barrel to recharge the container with toothpaste. For this purpose an end stop or stop means 140 is provided on the distal end of the rod so that the piston does not slip off the end of the shaft when it is being removed, after the end cap has been threadably removed from threaded engagement in the bore.

What is claimed is:

1. An improved toothbrush and toothpaste container, in combination, comprising:

a toothbrush having a brush portion and a stem portion and including an internal passageway from one end of the stem portion to exit ports in the brush portion and said stem portion comprising a container including a barrel having a proximal end and a distal end with a threaded through passageway extending from an open distal end, said passageway being of reduced diameter at the proximal end and including an intermediate portion of a predetermined cross sectional area greater than that at the distal end and less than that at the proximal end and of a predetermined axial dimension, a piston mechanism including a threaded piston in threaded engagement within the barrel and including an operator at all times exterior of the barrel effective to operate the piston to threadably move it axially within the passageway, a piston rod of a uniform cross section extending to said intermediate portion and including a distal portion of reduced cross sectional area extending axially in the intermediate portion a distance greater than the axial dimension of said piston, means on the piston normally urging the piston into a radially collapsed condition of a circumferential area sized for axial movement through the threaded portion of the passageway to remove the piston from said passageway and including abutment surfaces to coact with the rod to maintain the piston in threaded engagement within the passageway except when in the intermediate portion, stop means on the distal end of the rod to captivate the piston on the rod, means for holding the toothbrush and barrel together and means for holding the piston assembly removably in the barrel;

said piston shaft is of a rectangular cross section;

said piston mechanism includes an operator knob exteriorly of the barrel and driving connection means between the operator knob and the piston rod;

said means for holding the piston assembly removably in the barrel comprises a bushing type end cap with a nose portion sized for threaded engagement with the threads of the passageway; and said means normally urging the piston into a radially collapsed condition comprises an O-ring circumferentially seated in an annular groove in the piston and being at all times under tension when in assembly.

* * * * *